US005600898A

United States Patent [19]

Deshpande et al.

[11] Patent Number: 5,600,898

[45] Date of Patent: Feb. 11, 1997

[54] CURL CONTROL BY DRYER AIRCAPS IN TOP FELTED DRYER SECTION

[75] Inventors: Rajendra D. Deshpande, Rockton; Jeffrey H. Pulkowski, Roscoe, both of Ill.

[73] Assignee: Beloit Technologies, Inc., Wilmington, Del.

[21] Appl. No.: 527,048

[22] Filed: Sep. 12, 1995

[51] Int. Cl.[6] ..... F26B 11/02

[52] U.S. Cl. ..... 34/116; 34/114; 34/117

[58] Field of Search ..... 34/114, 116, 117, 34/115, 123, 120

[56] References Cited

U.S. PATENT DOCUMENTS

| | | | |
|---|---|---|---|
| 3,134,653 | 5/1964 | Justus et al. | 34/114 |
| 3,303,576 | 2/1967 | Sisson | 34/115 |
| 3,799,052 | 3/1974 | Küsters et al. | 100/93 |
| 3,874,997 | 4/1975 | Kankaanpää | 162/290 |
| 3,879,858 | 4/1975 | Candor et al. | 34/16 |
| 3,956,832 | 5/1976 | Justus | 34/115 |
| 4,194,947 | 3/1980 | Huostila et al. | 162/207 |
| 4,738,752 | 4/1988 | Busker et al. | 162/359 |
| 4,882,854 | 11/1989 | Wedel et al. | 34/115 |
| 5,033,207 | 7/1991 | Sturm et al. | 34/115 |
| 5,046,266 | 9/1991 | Autio | 34/120 |
| 5,063,689 | 11/1991 | Sollinger | 34/115 |
| 5,065,529 | 11/1991 | Skaugen et al. | 34/117 |
| 5,101,577 | 4/1992 | Wedel | 34/114 |
| 5,495,678 | 3/1996 | Ilmarinen et al. | 34/117 |
| 5,495,679 | 3/1996 | Deshpande et al. | 34/117 |
| 5,522,151 | 6/1996 | Deshpande et al. | 34/117 |

*Primary Examiner*—Henry A. Bennett
*Assistant Examiner*—Dinnatia Doster
*Attorney, Agent, or Firm*—Dirk J. Veneman; Raymond W. Campbell; David J. Archer

[57] ABSTRACT

The paper dryer section has a single tier of all top felted dryer rolls seven to nine feet in diameter. Air caps are employed over the dryer rolls to simultaneously dry both sides of the web to prevent curl and to increase drying rates. The air caps employ blown air at a temperature of 200–1,000 degrees Fahrenheit and air speeds of 8,000–40,000 feet per minute. The felt employed is foraminous with a permeability of between 300–1,500 cubic feet per minute per square foot and is designed to withstand peak temperatures of up to 1,000 degrees Fahrenheit and average temperatures of between 500–600 degrees Fahrenheit. A single dryer roll, or more advantageously, two vacuum rolls in a vacuum box are disposed between the dryer rolls to maximize the circumferential wrap of the web and, at the same time, support and transport the web between dryers.

5 Claims, 2 Drawing Sheets

CURL CONTROL BY DRYER AIRCAPS IN TOP FELTED DRYER SECTION

FIELD OF THE INVENTION

This invention relates to dryers used in papermaking in general. More particularly, this invention relates to dryers of the single tier type.

BACKGROUND OF THE INVENTION

Paper is made by forming a mat of fibers, normally wood fibers, on a moving wire screen. The fibers are in a dilution with water constituting more than ninety-nine percent of the mix. As the paper web leaves the forming screen, it may be still over eighty percent water. The paper web travels from the forming or wet end of the papermaking machine and enters a pressing section where, with the web supported on a felt, the moisture content of the paper is reduced by pressing the web to a fiber content of between thirty-five and fifty-five percent. After the pressing section, the paper web is dried on a large number of steam heated dryer rolls, so the moisture content of the paper is reduced to about five percent.

The dryer section makes up a considerable part of the length of a papermaking machine. The web as it travels from the forming end to the take-up roll may extend a quarter of a mile in length. A major fraction of this length is taken up in the dryer section. As the paper industry has moved to higher web speeds, upwards of four- to five-thousand feet per minute, the dryer section has had to become proportionately longer because less drying is accomplished at each dryer as the paper moves more quickly through the dryers.

One type of dryer, known as a two-tier dryer, has two rows of steam heated dryer rolls four to seven feet in diameter. The dryer rolls in the upper and lower rows are staggered. The paper web runs in a meandering fashion from an upper dryer roll to a lower dryer roll and then on to an upper roll over as many rolls as is required. An upper felt backs the web as it travels over the upper dryer rolls, and leaves the paper web as it travels to the lower rolls. The upper felt is turned by felt reversing rolls spaced between the upper rolls. On the lower dryer rolls the web is supported by a lower felt, which is also turned between lower dryer rolls by lower felt reversing rolls. This apparatus advantageously dries first one side and then the other of the web, however, the paper web is unsupported for a length as it passes from the upper dryer rolls to the lower dryer rolls, and from the lower rolls to the upper rolls. Unsupported paper webs present a problem as web speed increases. At higher web speeds, the paper interacts with the air and can begin to flutter. This fluttering can wrinkle and crease the paper web, seriously damaging the quality of the paper produced. Further, the fluttering can lead to tears and web failure, with all the cost and downtime associated with paper lost during the rethreading operation.

A first approach to overcoming this problem was to use a single felt or a wire which traveled with the paper web over both the upper and lower dryers so that the paper was supported through the open draws. This approach limited paper flutter in the open draws, but, because the blanket was disposed between the paper web to be dried and the lower dryer rolls, the effectiveness of the lower dryer rolls was substantially diminished.

A further dryer development is the single tier of dryer rolls with vacuum reversing rolls disposed therebetween. The vacuum rolls, such as shown in U.S. Pat. No. 4,882,854 (Wedel, et al.), use vacuum to clamp the edges of the paper to the reversing roll to prevent edge flutter, and use drilled holes or central grooves to allow passage of the trapped boundary layer between the blanket and the reversing rolls.

Single tier dryer systems are successful in increasing the drying rate and shortening the dryer section of a papermaking machine. It is necessary in order to dry both sides of the web effectively to employ both top felted and bottom felted single tiers of dryers. Bottom felted dryers have the disadvantage in that removing broke from between the felt and the dryer can be a difficult and time consuming operation. On the other hand, in the top felted dryers, when the felts are loosened, broke drops with relative ease out from between the felt and the dryer rolls. A further possible problem with single tier dryers is the sequential drying of first one side and then the other. When both sides of the sheet are not dried simultaneously curl can develop in the paper due to the effect of drying on the dimensions of the fibers on one side of the sheet as opposed to the still wet fibers on the other which can produce a tendency for the paper web to curl both in the cross machine and in the machine direction.

What is needed is a shorter dryer section which dries both sides of the web simultaneously and which facilitates rapid clearing of broke from the dryer section.

SUMMARY OF THE INVENTION

The paper dryer section of this invention employs a single tier of all top felted dryers. The dryer rolls are preferably of increased diameter, 8–20 feet in diameter, as opposed to the usual 6 foot diameter. The single tier arrangement, together with the top felting, assists in the removal of broke. Air caps are employed over the dryer rolls to simultaneously dry both sides of the web to prevent curl and to increase drying rates. The air caps employ blown air at a temperature of 200–900 degrees Fahrenheit and air speeds of 8,000–40,000 feet per minute. The felt employed is foraminous with a permeability of between 300–1500 cubic feet per minute per square foot and is designed to withstand peak temperatures of up to 900 degrees Fahrenheit and average temperatures of between 500–600 degrees Fahrenheit. Either one, or more advantageously, two felt rolls or two vacuum rolls in a vacuum box are disposed between the dryer rolls to maximize the circumferential wrap of the web and, at the same time, support and transport the web between dryers.

It is a feature of the present invention to provide a papermaking dryer apparatus which provides an increased rate of drying of a paper web.

It is another feature of the present invention to provide a more compact papermaking dryer section.

It is a further feature of the present invention to provide a papermaking dryer which prevents the formation of curl in the paper web being dried.

It is an additional feature of the present invention to provide a dryer section of a papermaking machine in which the ready removal of broke is facilitated.

It is yet another feature of the present invention to provide a dryer section of a papermaking machine which may be mounted directly to the mill floor wherein machine vibration and installation costs are reduced.

Further objects, features and advantages of the invention will be apparent from the following detailed description when taken in conjunction with the accompanying drawings.

DESCRIPTION OF THE PREFERRED EMBODIMENTS

Figure 1:
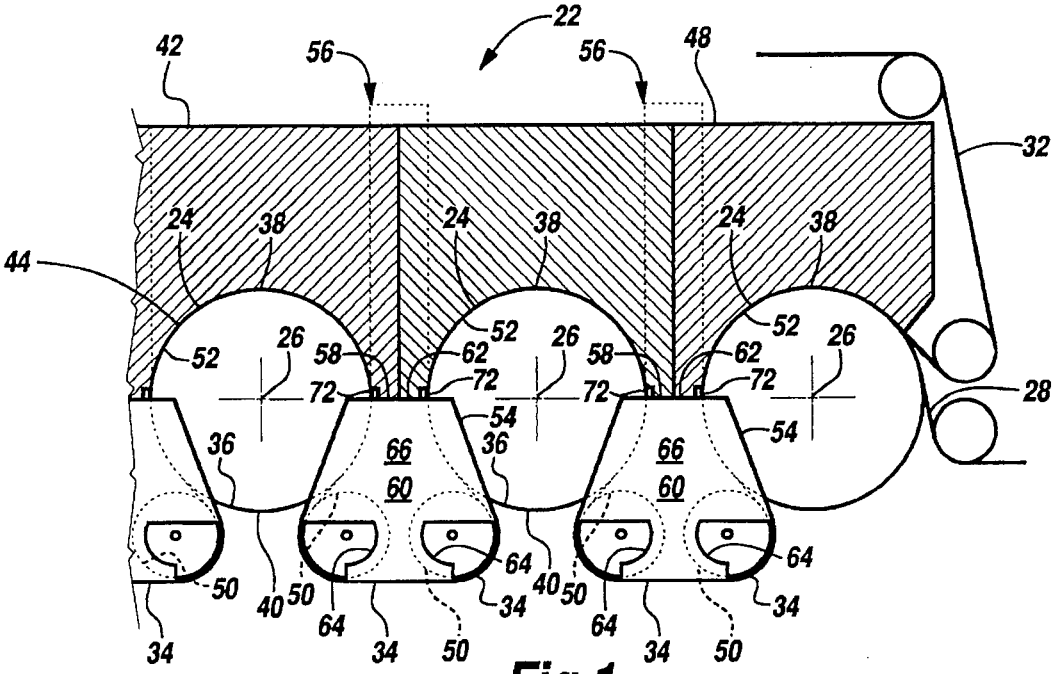
FIG. 1 is a schematic side-elevational view of the dryer section of this invention employing two reversing rolls.
Figure 2:
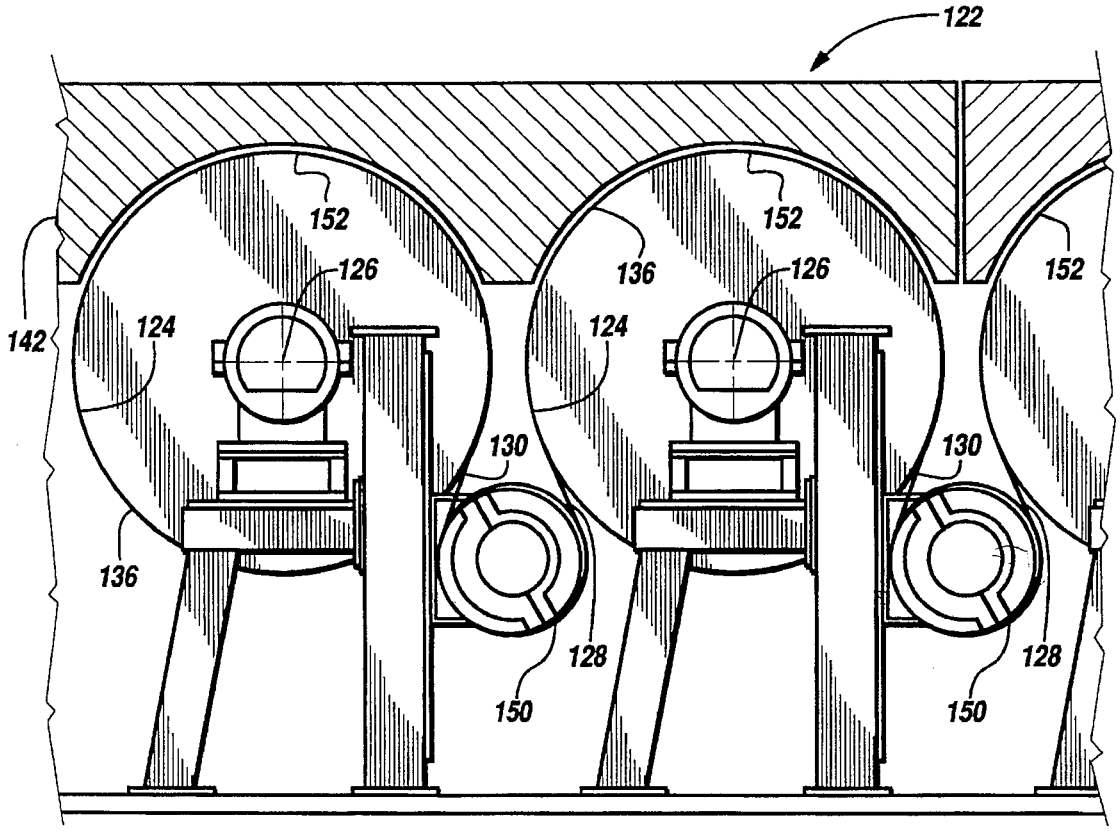
FIG. 2 is a somewhat schematic side-elevational view of the dryer section of this invention employing a single reversing roll.
Figure 3A:
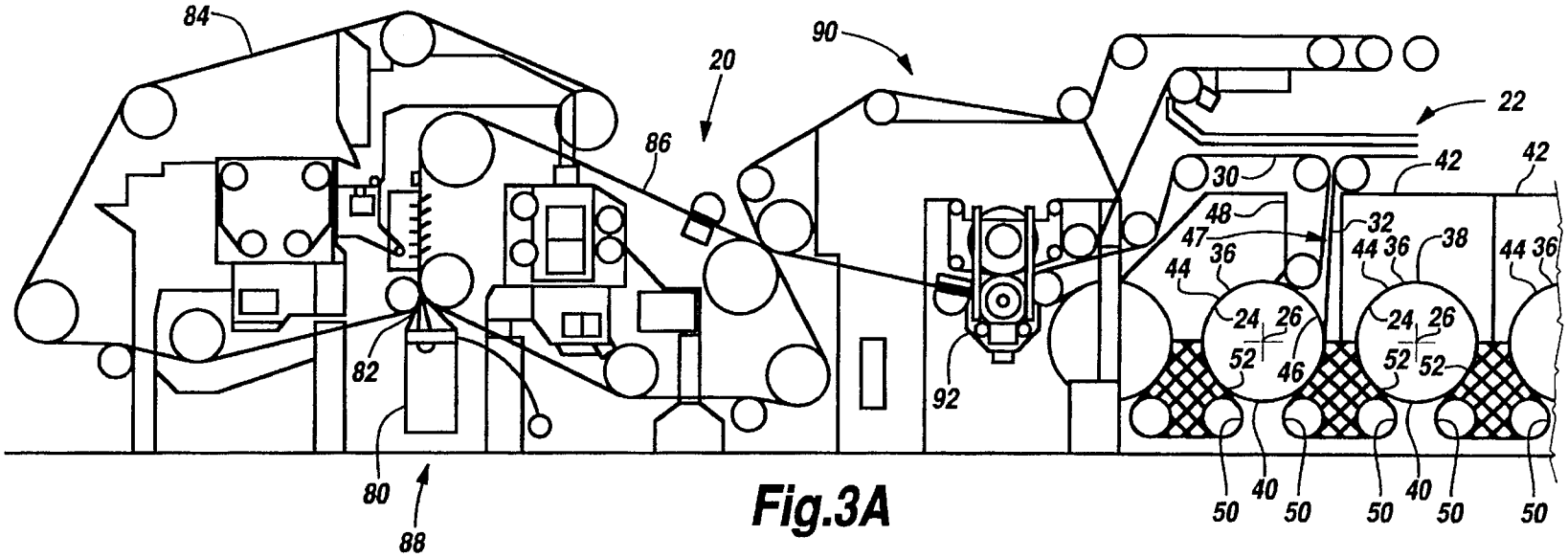
FIG. 3A is the wet end of an exemplary papermaking machine for supplying a web to the dryer section of FIG. 1.
Figure 3B:
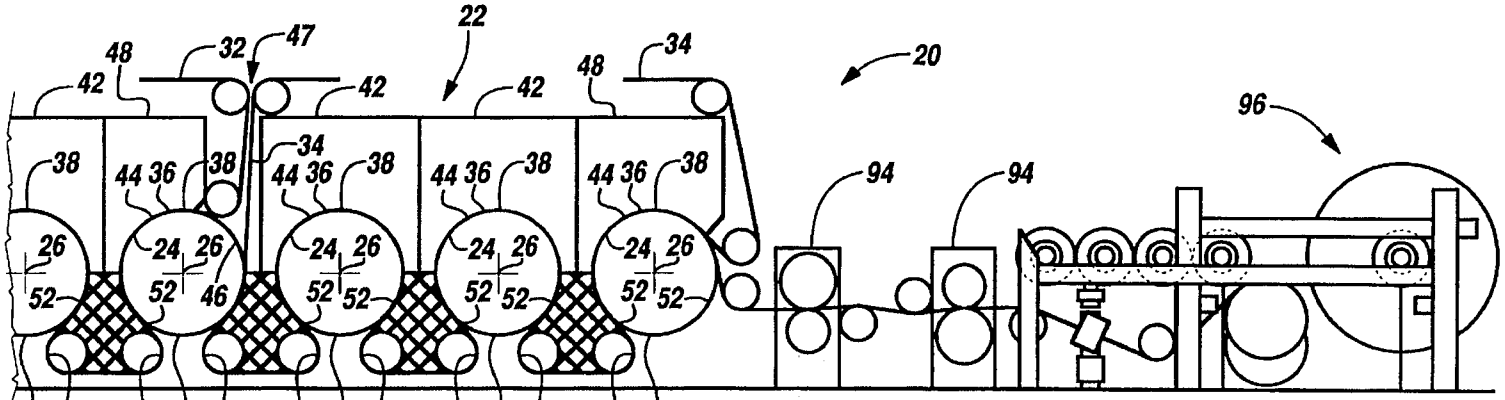
FIG. 3B is a schematic view of the dry end of an exemplary papermaking machine employing the dryer section of FIG. 1.

Referring more particularly to FIGS. 1–3B wherein like numbers refer to similar parts, a papermaking machine 20 is illustrated in FIGS. 3A–3B. The papermaking machine employs a dryer section 22. The dryer section is composed of dryer rolls 24 which are internally steam heated and will preferably have a diameter of eight to as large as twenty feet as opposed to conventional dryers of six feet in diameter. The dryer rolls rotate about axes 26, the axes lying in a single plane. Such an arrangement of dryer rolls is known as a single tier dryer section.

A paper web 28 is wrapped onto the dryer rolls 24 by first a first felt 30, then a second felt 32, and finally a third felt 34 in sequence, as the paper web moves through the dryer section 22. Each dryer roll 24 has a dryer surface 36. The dryer surface 36 is cylindrical and thus, has a circular cross-section. The circular cross-section has an uppermost or zenith point 38 and a lowermost or nadir point 40 at the bottom of each dryer roll 24. The felts 30, 32, 34 wrap the dryer rolls 24 so the tops or zenith points 38 of the rolls are covered but the nadir 40 or bottom of the rolls are not overwrapped. This application of the felts is referred to as top felting.

A top felted dryer section 22 has an advantage over bottom felted dryer systems in which the felts wrap the bottom or nadir points of the dryer rolls, in that broke may be much more easily cleared from the a top felted dryer section should a web break occur.

A papermaking machine 20 such as illustrated in FIGS. 3A–3B can operate in the range of 6,500 feet per minute. Paper breaks, while being highly undesirable on papermaking machines, are an inevitable occurrence particularly when the machine is changing between various grades of paper or when extensive maintenance and felt changes have been made. The high speed of the papermaking machine leads to an accumulation of a considerable quantity of broke or paper within the papermaking machine when a break occurs before the break can be detected and the machines shut down. The result is that the broken paper web will often wrap around individual dryer rolls. With top felting, the felts can be slacked off from the dryer rolls 24 and any accumulated paper readily removed from and dropped down from the dryer rolls. This is in contrast to bottom felted single tier dryers where it is necessary to fish the broke out from between the felt and the dryers, the felts forming pockets about the dryers which can accumulate and retain broken paper.

The disadvantage of single tier top felted dryers is that typically the paper web is dried from only a single side. This unidirectional drying of the paper web results in dimensional changes between the dryer side and the felt side of the web which, in turn, results in a permanent set or curling in the paper web which is an undesirable result. The dryer section 22 overcomes this problem by employing air caps 42 to dry the felt side of the web. The air caps 42 are hoods which overlie the upper portions 44 of the dryer rolls 24 and blow high velocity hot air through the felts to dry the upper surface of the web simultaneously and preferably at the same rate as the roll side of the paper is dried by the steam heat transmitted to the surface 36 of the dryer rolls 24.

In order to allow the passage of air through the felts 30, 32, 34 the felts must be of a porous or foraminous nature. Thus, the felts employed in the dryer section 22 will have a porosity in the range of three-hundred to fifteen-hundred cubic feet per minute per square foot as that porosity is typically measured by those skilled in the art of the design and construction of papermaking felts. The air supplied by the air caps 42 may have a temperature range of two-hundred to one-thousand degrees Fahrenheit and be blown at a velocity of between eight-thousand and forty-thousand feet per minute. The high air temperatures require felts which can withstand up to one-thousand degrees Fahrenheit for brief periods of time and average temperatures in the range of five-hundred to six-hundred degrees Fahrenheit.

Felts of this nature may be constructed of metal, high temperature plastics such as polyetheretherketone (PEEK), or other high temperature materials which can be formed into the necessary fibers. As shown in FIGS. 3A–3B, multiple felts 30, 32, 34 are employed. An exemplary transfer system, as illustrated in FIGS. 3A and 3B, is of the so-called lick-down web transfer wherein the paper web 28 is unbacked by felt over a short region 46 as it transits between the first felt 30 and the second felt 32 or the second felt 32 and the third felt 34. As shown in FIGS. 3A and 3B, the air caps 48 adjacent to the lick-down transfers 47 do not blow on the unbacked short region 46 so the unbacked web is not blown off the dryer surface 36.

The web 28 is transferred between the multiple dryer rolls 24 of the single tier. Because only a single tier of dryers 24 is employed in the dryer section 22, reversing rolls 50 are used to transfer the paper web 28 from the surface 36 of one dryer roll to the surface 36 of an adjacent dryer roll. In order to maximize the amount of drying achieved per dryer roll 24 it is desirable that the web be wrapped about the maximum portion practical of the dryer surface 38 of each dryer roll 24. As shown in FIGS. 1 and 3A–3B the employment of two spaced apart reversing rolls 50 maximizes the portion 52 of the roll surface 36 which is wrapped by the felts 30, 32, 34. The dryer section 24 shown in FIGS. 1 and 3A–3B wraps a portion 52 comprising approximately eighty percent of the dryer roll's surface 36, in the case of an eight foot diameter dryer.

As shown in FIG. 1, where dual reversing rolls 50 are employed it is desirable to support the web 28 as it moves around the reversing rolls 50 to prevent fluttering and thus paper breaks. A vacuum chamber 54 is formed by a rigid metal structure 58 located between gaps 56 between dryer rolls 24. The vacuum chamber 54 is formed by a metal cover 58 which is sealed against the moving dryer felts 30, 32, 34 to define an internal volume on which reduced pressure is drawn. The cover 58 is comprised of two side plates 60, one of which is shown in FIG. 1. The side plates are joined along the top by a top plate 62. Each side plate 60 has two clearance openings 64 which are smaller in diameter than the reversing rolls 50.

The reversing rolls 50 preferably are formed with circumferential grooves which facilitate holding the paper web and the felts to the reversing roll 50. The reversing rolls 50 are rotatably mounted within the vacuum chamber 54. The openings 64 provide clearance for the side wall extensions of the shafts (not shown) on which the rolls 50 are mounted.

The side plates 60 oppose each other and are perpendicular to the central axes 26 of the dryer roll 24. A hole (not shown) is cut through the side plate 60 which allows for the drawing of a vacuum on the vacuum chamber 54 by an external vacuum means (not shown). Each side plate 60 has an upper segment 66 which extends above the grooved rolls 50 and a downwardly extending tab 68 which blocks escaping air to the sides of the grooved rolls. A lower horizontal edge 70 of the tab 68 engages with the dryer felt 30, 32, 34 as it passes between the two grooved rollers 50. Stiffening ribs (not shown) may project inwardly from the inner perimeter of the side plates 60 to prevent excessive deflection of the plates by the application of vacuum. Two inclined flanges 72 extend from the top plate 62 between the side plates 60. Each inclined flange 72 extends upward of the top plate 62 and inward towards the center of the top plate 60, thereby forming an acute angle with the top plate 62. The net result of the grooved rollers 50 and the vacuum box 54 is to restrain the web and the backing felt from fluttering as it transfers from one dryer roll to the next whilst preventing paper breaks.

Alternatively, a passive box could be employed. As shown in FIG. 2, an alternative dryer section 122 employs dryer rolls 124 and air caps 142. The dryer section 124 is similar to the dryer section 24 of FIG. 1, only a single turning roll 150 is employed to transfer the web 128 and felt 130 between dryer rolls 124. The result of employing a single turning roll reduces the complexity of the dryer section 122. However, the use of a single turning roll results in a wrapped portion 152 which is a somewhat smaller percentage of the total surface area 136 of the roll when compared to the wrapped percentage of the dryer section 22 of FIG. 1.

An exemplary paper machine 20 employing the dryer section 22 is shown in FIGS. 3A–3B. The papermaking machine 20 illustrated can be used to produce twenty-eight pound newsprint with a wire width of four-hundred-and-twenty inches and operating at a speed of sixty-five-hundred feet-per-minute. The papermaking machine 20 employs a vertically oriented headbox 80 which has a slice 82 which injects a stream of pulp between a first forming wire 84 and a second forming wire 86 which comprises the twin wire former 88. The paper web 36 is transferred to a press section 90 where a single extended nip press 92 accomplishes the pressing function. The web 36 is then wrapped onto the first dryer felt 30 and transferred to the dryer section 22. After transiting the dryer section the web is calendered with high temperature soft nip calenders 94 and wound onto reels by a winder 96.

In a preferred system, the twin wire former may be a Bel-Baie RCB type enclosed jet former obtainable from Beloit Corporation. The headbox used will preferably be the Concept IV-MH headbox employing consistency profiling, also available from Beloit Corporation. Press sections, high temperature soft nip calenders and reels are also available from Beloit Corporation.

The papermaking machine 22 employing the dryer section 24 may be observed to be of compact design with relatively few dryer rolls as well as few rolls of any type. Because of the high cost of individual rolls, together with their bearings and support system, a papermaking machine such as illustrated in FIGS. 3A–3B will result in improved cost and reliability performance.

It should be understood that the air temperature used in the dryer air caps may be varied between the wet end and the dry end of the dryer.

It should also be understood that an exemplary air velocity of twenty-eight-thousand feet per minute and an air temperature of seven-hundred-fifty degrees may be employed.

It should be understood that greater dryer surface for a given floorprint may be achieved by using larger dryers and that dryer technology used in the manufacturer of Yankee dryers assures that dryers as large as twenty feet can be constructed.

It should also be understood that a further advantage of the dryer section 22 of this invention is that because all the dryers are in a single tier it is possible to mount the dryer section directly to the mill floor without the necessity of constructing basements under the dryer. This relatively simple and more rigid mounting will reduce dryer vibrations as well as reduce dryer installation costs.

It should also be understood that although three dryer felts are shown, more or less felts could be used. The advantages of employing greater numbers of felts are threefold. One, the paper lengthens and shortens slightly as the drying process is accomplished and therefore the dryer rolls are required to run more rapidly as the paper progresses through the dryer section 22. The more drying felts, the more stages in which the paper speed can be increased. Secondly, changing felts prevents a single felt from impressing a pattern onto the surface of the web. Thirdly, it is to be understood that shorter felts are more easily changed.

It is understood that the invention is not limited to the particular construction and arrangement of parts herein illustrated and described, but embraces such modified forms thereof as come within the scope of the following claims.

We claim:

1. A dryer section of a papermaking machine comprising:

a plurality of dryer rolls, wherein each dryer roll defines an axis of rotation, and wherein the axes of rotation of the plurality of dryer rolls are arrayed in substantially a single plane, and wherein each dryer roll has an uppermost zenith and a lowermost nadir:

at least two turning rolls between each of said plurality of dryer rolls, wherein said turning rolls have axes of rotation positioned below the common plane containing the dryer roll axes of rotation;

at least one foraminous felt wrapped around said plurality of dryer rolls and turning rolls wherein the felt wraps each zenith point of each dryer roll and does not wrap the nadir point of any dryer roll;

an air cap positioned above the dryer rolls on the at least a portion of the felt as it overwraps the dryer roll; and a vacuum box disposed between adjacent dryer rolls and said turning rolls positioned therebetween to prevent fluttering of a paper web as it travels between adjacent dryer rolls.

2. The apparatus of claim 1 wherein the dryer rolls are at least six feet in diameter.

3. The apparatus of claim 1 wherein the dryer rolls are between six and twenty-five feet in diameter.

4. The apparatus of claim 1 wherein at least two distinct dryer felts are employed in the dryer section so the speed of a paper web transiting the dryer section may be increase as the web moves through the dryer section and increases in length.

5. The dryer section of claim 2 wherein the foraminous felt wraps approximately 290 degrees of each dryer roll.

* * * * *